US005104682A

United States Patent [19]

Nakahama et al.

[11] Patent Number: 5,104,682

[45] Date of Patent: Apr. 14, 1992

[54] COATING METHOD

[75] Inventors: Tadamitsu Nakahama; Yoshio Tanimoto; Takakazu Yamane, all of Hiroshima, Japan

[73] Assignee: Mazda Motor Corporation, Shinchi, Japan

[21] Appl. No.: 390,408

[22] Filed: Aug. 7, 1989

[30] Foreign Application Priority Data

Aug. 9, 1988 [JP] Japan ..... 63-197037

[51] Int. Cl.[5] ..... B05D 1/04; B05D 3/12

[52] U.S. Cl. ..... 427/27; 427/240; 427/346; 427/425

[58] Field of Search ..... 427/240, 346, 425, 27; 118/56

[56] References Cited

U.S. PATENT DOCUMENTS 4,874,639 10/1989 Matsui et al. ..... 118/56 X
4,919,977 4/1990 Yamane et al. ..... 427/425 X
4,968,530 11/1990 Yamane et al. ..... 427/425 X

*Primary Examiner*—Evan Lawrence
*Attorney, Agent, or Firm*—Fish & Richardson

[57] ABSTRACT

A highly reflective surface coating on a substrate is formed by a coating method in a coating line. A paint is sprayed on the substrate in a viscosity of 18 seconds or lower when measured by means of Ford Cup #4 at 20° C. in a film thickness thicker than a thickness at which the paint sags, the paint containing a solvent or solvents, having a boiling point as high as 110° C. or lower in an amount of 50% by weight or higher.

After completion of the spraying, a coat of the paint is dried by a drying step including sequential setting and baking steps. The substrate is held in an ambient temperature during the setting step which is lower than the ambient temperature during the baking step, and the rotation of the substrate in the drying step being carried out about its horizontal axis at a speed which is high enough to rotate the substrate from a vertical position to a horizontal position before the paint coated thereon substantially sags due to gravity yet which is low enough so as to cause no sagging as a result of centrifugal force, thereby allowing the coat formed thereon to achieve a substantially sagless state.

This coating method prevents the paint from swelling on an edge portion of the substrate forming a mass, whereby a coat surface is provided with a high degree of flatness.

36 Claims, 7 Drawing Sheets

W
a

COATING METHOD

BACKGROUND OF THE INVENTION

1. Field of the Invention

The present invention relates to a coating method.

2. Description of Related Art

A coating method for coating an outer surface of a substrate such as a vehicle body generally includes a preparation step for preparing for the substrate to be coated with a paint by removing dust or other foreign materials from the substrate, a coating step for spraying the substrate with the paint, and a drying step for drying the coat thereon. The drying step generally comprises sequential setting and baking steps in particular when a thermosetting paint is used. The setting step is usually carried out prior to the baking step at an ambient temperature which is lower than the ambient temperature during the baking step, for example, at room temperature or at temperatures ranging from 40° C. to 60° C., in order to volatilize a solvent slowly so as to prevent a formation of pinholes on the coat surface during the baking step which is usually carried out at approximately 140° C.

The substrate is held at a given position on a conveyance means such as a carriage while being conveyed during the preparation, coating, and drying steps.

A degree of flatness or smoothness on the surface of a coat on the substrate is one of standards for evaluating a quality of the coat. The higher a degree of flatness the smaller a degree of irregularities on the coat surface, thus producing a better coat. It is well known that a thicker film thickness of a paint may give a higher degree of flatness on a coat surface. A paint sprayed on the surface of a substrate may be said to sag when it is visually observed that the paint sprayed thereon flows and finds a trace of movement on the coat by 1 mm to 2 mm from a site where the paint was sprayed until it is cured in the drying step. It may be defined herein that a sag of the paint occurs if such a trace exceeds at least 2 mm when visually observed. In other words, a sagging limit thickness of a paint is a film thickness beyond the maximum film thickness at which the paint does not sag at least in the drying step if it is left as it was sprayed. Thus, a film thickness of the paint within its sagging limit thickness is a film thickness in which it does not sag in the drying step even if it is left as it was sprayed. On the contrary, a film thickness thicker than its sagging limit thickness of the paint is a film thickness at which the paint causes sagging at least during the drying step when it is stayed as it was sprayed.

The paint causes sagging when the paint coated thereon flow downwardly due to gravity. The paint becomes more likely to cause sagging as a film thickness of the paint sprayed gets thicker. Thus it is a matter of course that the paint sags more likely on a surface of the substrate extending in an up-and-downward direction, i.e., a vertically extending surface, than on a surface thereof extending in a horizontal direction, i.e., a horizontally extending surface. This enables the paint to be coated on the horizontally extending surface in a film thickness thicker than on the vertically extending surface because the sags or drips of the paint little affect adversely the coat sprayed on the horizontally extending surface of the substrate. If the film thickness of a coat on the horizontally extending surface is the same as that on the vertically extending surface, the former can produce a coat with a degree of flatness higher than the latter because the paint sprayed on the horizontally extending surface becomes flattened due to a natural flow in the paint to an extent to which no sags substantially occur.

Conventionally, in order to provide a coat with a higher degree of flatness while preventing sags or drips of a paint coated on a surface of the substrate, there have been used paints which are lower in viscosity and less flowable. Even if such a thermosetting paint is used, however, a sagging limit thickness of the paint sprayed on the vertically extending surface is as high as approximately 40 μm. This sagging limit thickness is the maximum film thickness in which the paint does not substantially sag on the vertically extending surface of a substrate. In other words, the paint is likely to sag or drip in initial stages of the setting and baking steps, particularly in the initial stage of the baking step. Accordingly, a film thickness of the coat is determined by a film thickness of the paint to be sprayed on the surface of a substrate to such an extent that the paint does not sag on its vertically extending surface. In order to produce a coat in a film thickness thicker than a sagging limit thickness of the paint, the spraying step is repeated twice or more in conventional coating method.

Attempts have been made to complete with the problem with spraying the paint in a film thickness thicker than its sagging limit thickness, and we have developed a technology that enables forming a coat having coat properties superior to coats obtainable by conventional coating methods, when sprayed in the same film thickness, as disclosed in our U.S. Pat. application Ser. No. 100,767, now U.S. Pat. No. 4,874,639 This technology involves spraying a vehicle body with the paint in a film thickness thicker than its sagging limit thickness and rotating the body about its substantially horizontal axis at least until the paint in the coat sprayed thereon is cured so as to cause no sagging any more. This coating method rather takes advantage of gravity that causes sags of the paint sprayed and the substrate is rotated so as to alter its direction in which gravity acts on the coat surface on the body, thereby preventing sags from occurring in the coat thereon while positively utilizing a flowability inherent in the paint and yielding a coat with a higher degree of flatness than coats obtainable by conventional coating methods. Thus this technology is an excellent coating method in itself.

It has now been found, however, that there is still a room for improvement in the above-described technology because, when a highly flowable paint is sprayed in a film thickness thicker than its sagging limit thickness, the paint sprayed on the substrate may swell on an edge portion thereof to form a mass of the paint. As a result of review on this problem, it has been found that the highly flowable paint sprayed gets flattened by means of a surface tension acting upon the coat surface, but the paint, once flattened, then moves in one direction toward the edge portion of the substrate by means of a surface tension, forming a swelled mass of the paint.

SUMMARY OF THE INVENTION

Therefore, the present invention has the object to provide a coating method which permits preventing the paint from swelling on an edge portion of a substrate so as to form no mass of the paint.

The present invention has been accomplished by focusing on the fact that a phenomenon in which the paint sprayed swells on an edge portion of the substrate may occur after irregularities on the coat surface have been flattened. In other words, as there is a time difference between the phenomenon of the paint swelling and the flattening of the coat surface thereon, a paint to be used is designed such that its high flowability is utilized immediately after it was sprayed and then such that its flowability gets reduced after the coat surface becomes substantially flat, thereby overcoming the disadvantage encountered with the above-described technology.

In order to achieve the object, the present invention consists of a coating method in a coating line for coating a substrate with a paint containing a volatilizable solvent to form a highly reflective surface coating on the substrate, comprising: a spraying step in which the paint is sprayed to form a coat in a film thickness thicker than a thickness at which the paint sags on a surface extending at least upwardly and downwardly; and a drying step comprising sequential setting and baking steps in which the substrate is held in an ambient temperature during the setting step which is lower than the ambient temperature during the baking step and in which the substrate is rotated about its horizontal axis until the paint sprayed thereon achieves a substantially sagless state, the rotation of the substrate in the setting step being carried out at a speed which is high enough to rotate the substrate from a vertical position to a horizontal position before the paint coated thereon substantially sags due to gravity yet which is low enough so as to cause no sagging as a result of centrifugal force; wherein the paint is sprayed on the substrate in a viscosity of 18 seconds or lower when measured by means of Ford Cup #4 at 20° C., the paint containing a low-boiling-point solvent or solvents, having a boiling point of 110° C. or lower in an amount of 50% by weight or higher.

In accordance with the present invention, a film thickness of the paint per one spraying can be made thicker than conventional methods, thereby providing a highly reflective coat surface having a degree of flatness much higher than a level that has been so far considered as a limit.

When the paint is sprayed in a film thickness substantially the same as in conventional methods, the present invention provides a coat surface with a higher degree of smoothness, namely, lesser in irregularity, than those obtained by means of the conventional ones.

If it is sufficient to form a coat surface having a degree of flatness or smoothness as high as those obtainable by conventional methods, the present invention can achieve such a degree of flatness on the coat surface with a lesser amount of the paint. This serves as saving an amount of the paint.

It is to be noted that the coating method according to the present invention can prevent the paint from swelling on an edge of the substrate by using the paint having the composition as has been described hereinabove and claimed.

The spraying of the paint may be effected by means of an electrostatic spraying or the like. As has been described hereinabove, it is further to be understood that the paint is determined herein to sag when it is visually observed that the paint flows generally by approximately 2 mm if it is stayed as it was sprayed. Sags of the paint are left as marks on the coat surface in a string-like form when the paint is cured. Thus the spraying of the paint in a film thickness thicker than its sagging limit thickness results in the fact that the paint flows in a length longer than 2 mm when it is stayed untreated as it was sprayed. It is found as a matter of course that the higher a flowability of the paint the thinner its sagging limit thickness of the paint to be sprayed. In order to allow the paint to be sprayed in a film thickness thicker than its sagging limit thickness, the paint may be sprayed once (one-stage spraying) or twice or more (multiple-stage spraying).

It is also to be noted that the rotation of the substrate be carried out about its substantially horizontal axis in such a manner that the paint sprayed is not caused to move to a large extent due to gravity. The substrate is rotated continuously or intermittently in one direction or in alternate directions until the paint gets cured and as a result becomes in a substantially sagless state. Furthermore, an angle at which the substrate is rotated about its horizontal axis is approximately 270 degrees because it is sufficient that a direction can be reversed, in which gravity acts upon a site sprayed with the paint in a film thickness above its sagging limit thickness. The axis about which the substrate is rotated may be inclined at approximately 30 degrees relative to the real horizontal axis thereof or may be pivoted.

The other objects and features of the present invention will become apparent in the course of the description of this specification.

DETAILED DESCRIPTION OF THE PREFERRED EMBODIMENTS

Outline of Coating Method

Figure 1:
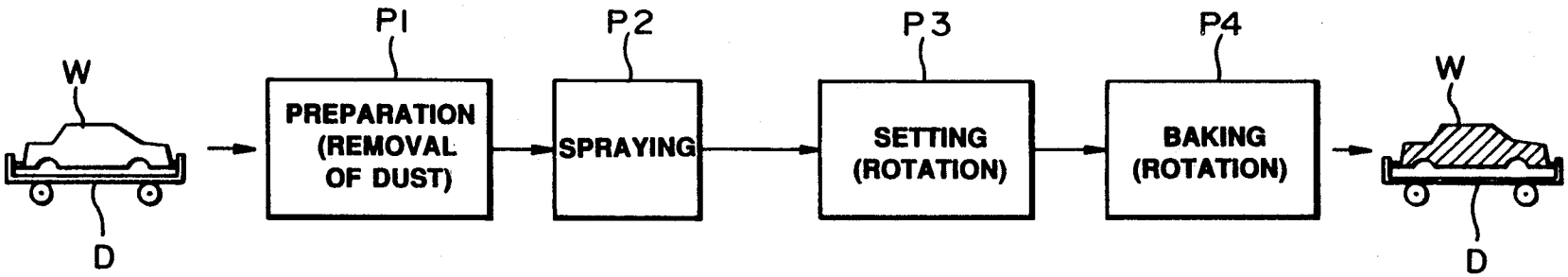
FIG. 1 is a schematic diagram showing an outline of the coating method according to the present invention.

FIG. 1 shows an outline of the whole steps of the coating method according to the present invention, in which a vehicle body W as a substrate is coated by spraying the substrate with a paint. As shown in FIG. 1, the coating method according to the present invention comprises roughly the the preparation step P1, the spraying step P2, the setting step P3, and the baking step P4. In this specification, the terms "drying step" is intended to mean a sequential combination of the setting step P3 with the baking step P4, unless otherwise stated specifically.

The vehicle body W is first undercoated by conventional methods such as electrodeposition. The vehicle body W undercoated is conveyed while being supported by a carriage D to the preparation step P1. In the preparation step P1, dust and other foreign matters are removed from the inside and the outside of the vehicle body W, for example, by vacuum suction or air blowing for subsequent coating procedures. Then the vehicle body W is coated by spraying the body with a paint in conventional manner in the spraying step P2 and the coat is then dried in the setting step P3 and in the baking step P4.

If the coating procedures from the steps P1 to P4 are for coating the body W with an intercoating paint, then the body W is then conveyed to a series of overcoating procedures and sprayed with an overcoating paint in the spraying step P2 and the overcoat was dried in the sequential setting and baking steps P3 and P4. If the coating procedures from the step P1 to P4 are for coating the body W with the overcoating paint, the body W overcoated is then conveyed to an assembly line in conventional manner.

Removal of Dust

In the preparation step P1, dust and other foreign matters are removed from the inside and outside of the vehicle body W by vacuum suction or air blowing. In the preparation step P1, the body W may be preferably rotated about its horizontal axis l, i.e., about an axis extending substantially horizontally in a longitudinal direction of the body W, as will be described in detail in conjunction with FIG. 2.

Figures 2A, 2B, 2C, 2D, 2E, 2F, 2G, 2H, 2I:
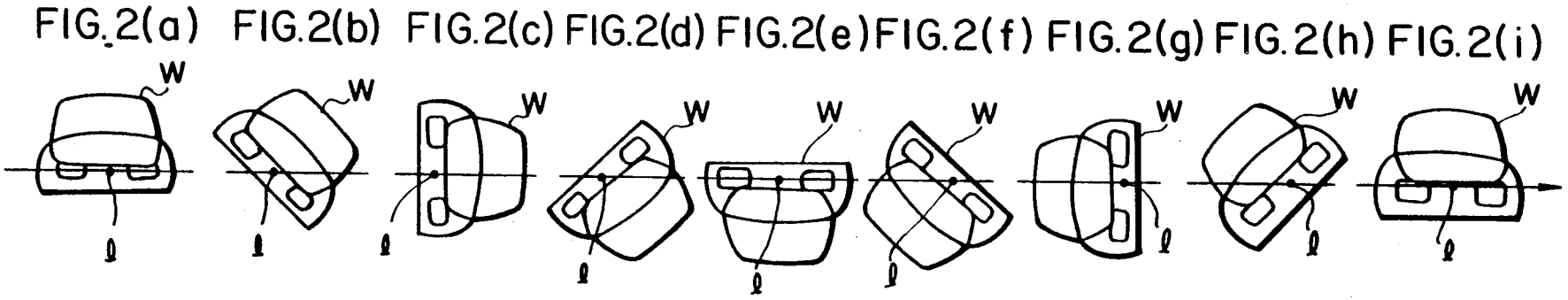
FIGS. 2(*a*), 2(*b*), 2(*c*), 2(*d*), 2(*e*), 2(*f*), 2(*g*), 2(*h*) and 2(*i*) are schematic diagram showing a variation of positions of a vehicle body at which it is rotated.

More specifically, referring to FIG. 2, dust and foreign matters are removed while the body W is held in the posture as shown in FIG. 2(*a*) and then rotated to the posture as shown in FIG. 2(*b*). The rotation of the body W is then suspended in that posture and dust and so on are removed. The body W is rotated intermittently to the posture as shown in FIG. 2(*c*) and then through (*d*), (*e*), (*f*), (*g*), and (*h*) to the original posture as shown in FIG. 2(*i*).

The rotation of the body W in the manner as have been described hereinabove may readily remove dust and other foreign matters from corner portions inside a roof panel, a side sill and other partially closed sections which could not otherwise be removed without rotation of the body W.

Spraying And Drying

The vehicle body W may be preferably sprayed with the paint in the spraying step P2 in such a manner that the paint sprayed on the surface of the body W sags at least in one of the setting step P3 and the baking step P4 yet causes no sagging at least in approximately two minutes after completion of the spraying step P2 and transferal of the substrate to the following step. The time as long as two minutes is set on the basis of the fact that approximately two minutes will be required until an entire portion of the body W has been sprayed with the paint from the start of spraying and the body W has then been transferred to the setting step P3. This means that the paint sprayed causes no sagging at a portion which has first been sprayed until the spraying of the whole body is finished, thereby ensuring a prevention of sagging in the spraying step P2. The spraying is preferably effected by means of electrostatic coating or spraying.

The spraying is a preferred feature of coating the body W with the paint because it permits a ready management and control over a film thickness of the coat to be sprayed on the surface of the body W. It is to be understood herein that the electrostatic coating is to be contained in this concept of spraying.

It should be noted that the spraying referred to herein is thoroughly different from dipping. Dipping of the body in a bath of the paint apparently causes the paint to drip and sag from the surface of the body at the instance at which the body was drawn up from the paint bath. At that time, the paint on the surface of the body moves in a length that is longer than 1 to 2 mm when visually observed. This magnitude is much larger than a sagging limit thickness of the paint used. Even if the body coated with the paint in such a thick film thickness would be rotated, a portion where the paint has sagged can provide no coat surface which is as smooth or flat as other portions where no sagging has been caused.

In accordance with the present invention, as the coat sprayed on the surface of the body W is caused to sag in either of the setting step P3 or the baking step P4, the film thickness can be thicker than the possible thickest film thickness obtainable by means of conventional procedures. It is a matter of course that, in accordance with the present invention, the coat may have a film thickness as thick as or thinner than conventional one.

The body W coated in the spraying step P2 in such a state as causing no sagging is then conveyed to the drying step which usually consists of the setting step P3 and the baking step P4.

Rotation of The Substrate

In the setting step P3, the vehicle body W is rotated about its horizontal axis, for instance, in such a manner as shown in FIGS. 2(*a*) to (*i*), an axis extending horizontally in the longitudinal direction of the body W and the rotation of the body W being carried out about its horizontal axis l continuously or intermittently in one direction or in alternate directions.

Referring to FIG. 2, FIG. 2(*a*) shows an original position at which the body W is mounted on the carriage. FIG. 2(*b*) shows a position of the body W in which it is rotated at 45 degrees from the original position of FIG. 2(*a*). FIGS. 2(*c*), (*d*), and (*e*) show positions at which it is rotated at 90 degrees, 135 degrees, and 180 degrees, respectively, from the original position thereof. As shown in FIGS. 2(*f*), (*g*), and (*h*), the body W is further rotated at 225 degrees, 270 degrees, and 315 degrees, respectively, from the original position shown in FIG. 2(*a*). FIG. 2(*i*) shows the position at which the body is rotated at 360 degrees from and returned to the original position of FIG. 2(*a*). It should be understood that FIG. 2 is shown merely as references and that the body W may take any position. The rotation of the body W may be carried out on the carriage continuously or intermittently in one direction or in alternate directions in a cycle of rotation in which the body W is turned about its horizontal axis so as to allow every vertically cross-sectional portion of the body W passing through the center of its horizontal axis to pass in equal occasions through the direction of gravity passing through the center thereof. If the body W is rotated in one direction, the rotation may be continuously or intermittently carried out in a clockwise direction in FIG. 2, for example, in a cycle from the original position of FIG. 2(*a*) through FIGS. 2(*b*), (*c*), (*d*), (*e*), (*f*), (*g*), and (*h*) to the original position of FIG. 2(*i*). If it is rotated continuously or intermittently in alternate directions, the rotation may be carried out first in the clockwise direction in FIG. 2, for example, in a first quarter of one cycle from the original position of FIG. 2(*a*) through FIG. 2(*b*) to the position of FIG. 2(*c*) and then reversed back in a counterclockwise direction in a second quarter thereof from FIG. 2(*c*) through FIG. 2(*b*) to the original position of FIG. 2(*a*) and then in a third and quarter thereof from the original position of FIG. 2(*i*), i.e., FIG. 2(*a*), through FIG. 2(*h*) to the position of FIG. 2(*g*). In this case, the rotation of the body W is reversed again in a counterclockwise direction in a fourth quarter of one cycle from the position of FIG. 2(*g*) through FIG. 2(*h*) to the original position of FIG. 2(*i*), namely, FIG. 2(*a*). Furthermore, for example, if the rotation of the body W is reversed at the angle of 135 degrees, the body W is rotated first in a clockwise direction from the original position of FIG. 2(*a*) through FIGS. 2(*b*) and 2(*c*) to FIG. 2(*d*), and the rotation is reversed back in a counter-clockwise direction therefrom through FIGS. 2(*c*) and (*b*) to FIG. 2(*a*). The body W is continued to be rotated therefrom, namely, from FIG. 2(*i*) through FIGS. 2(*h*), (*g*) to FIG. 2(*f*) and then reversed again in a clockwise direction therefrom through FIGS. 2(*g*) and (*h*) to FIG. 2(*i*), namely, to the original position of FIG. 2(*a*). It is to be noted that the rotation of the body W may be reversed at any angle and it is not restricted at any means to those as have been described hereinabove. The angle at which the rotation of the vehicle body W is reversed may be determined on the basis of a direction in which gravity acts on the coating particularly on the up-and-downward direction and of a shape of the vehicle body W, particularly a location of its corner portions, and the like. Furthermore, it is to be noted that the rotation may be carried out intermittently in such a manner that the rotation is continued by repeating a run-and-stop operation.

A speed of the rotation of the vehicle body W may be determined depending upon a viscosity of the paint and a film thickness thereof coated on the surface of the body W and may vary within the range between the maximum value and the minimum value, a maximum value being defined as the maximum rotational speed at which the paint coated thereon causes no sagging as a result of centrifugal force and a minimum value being defined as the minimum rotational speed at which the surface is rotated from its vertical state to its horizontal state before the paint on the coaing surface substantially sags due to gravity. The body W is preferably rotated at a speed of 380 cm per second or lower as measured at a radially outward tip portion of the body.

An angle at which the body W is rotated about its substantially horizontal axis may be inclined at approximately 30 degrees, preferably at approximately 10 degrees, with respect to its horizontal axis.

A period of time when the rotation of the vehicle body W is carried out is sufficient if it lasts at least from the instance when the coating starts sagging to the instance when the coating is cured to such an extent to cause no sagging during the drying step. It is also possible to carry out the rotation all over the drying step for any reasons including instrumental demands and so on.

An ambient temperature in the setting step P3 may be as high as 40° C. to 60° C., although the ambient temperature is set at room temperature in this embodiment, a temperature being set in a range which is lower than an ambient temperature during the baking step P4. The setting step P3 is to volatilize components volatile at low boiling points in the paint of the coating, thereby preventing an occurrence of pinholes on the coat surface due to rapid volatilization of components having such low boiling points.

In the baking step P4, the coat on the surface of the vehicle body W is baked at an ambient temperature as high as, for example, 140° C. When the paint used for coating the body W is of the type that sags in the baking step P4, the body W may be rotated about its horizontal axis in the manner, for example, as shown in FIGS. 2(*a*) to (*i*), in substantially the same manner as in the setting step P3 as have been described hereinabove.

The rotation of the body W during the setting step P3 and/or the baking step P4 permits drying the coat on the body W without leaving any marks or scars of sags on the coat surface while providing a highly reflective surface coat on the body with a degree of smoothness higher than coat surfaces obtainable by conventional methods.

Relationship of Film Thickness of Paint with Speed of Paint Sagging

Figure 3:
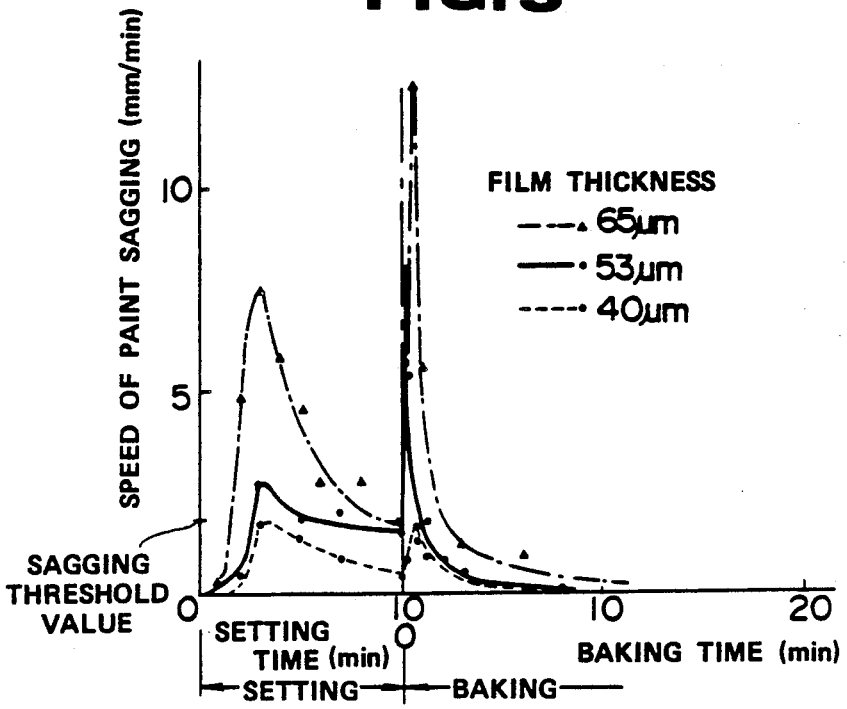
FIG. 3 is a graph showing the relationship of the setting and baking times vs. speeds at which the paint sags.

FIG. 3 demonstrates the influence of film thicknesses of a paint upon the speed at which the paint sags. The speeds of paint sagging are measured for three different film thicknesses of 40 μm, 53 μm, and 65 μm. As shown in FIG. 3, it has been found that a peak of the sagging speed appears at initial stages of the setting and baking steps in each case.

It should be noted that the term "sagging limit thickness" or related terms mean a value that the paint coated on the body moves by 1 to 2 mm during the drying step as have been described hereinabove. More specifically, the term is intended to mean a limit of a film thickness in which a mark or scar is visually recognized after the drying step as a result of the paint having moved by 1 to 2 mm on the coat surface from the position where the paint was coated. For conventional paints, the maximum film thickness obtainable within the sagging limit thickness are in the range from approximately 35 to 40 μm.

Relationship of Film Thickness with Degree of Flatness

Figure 4:
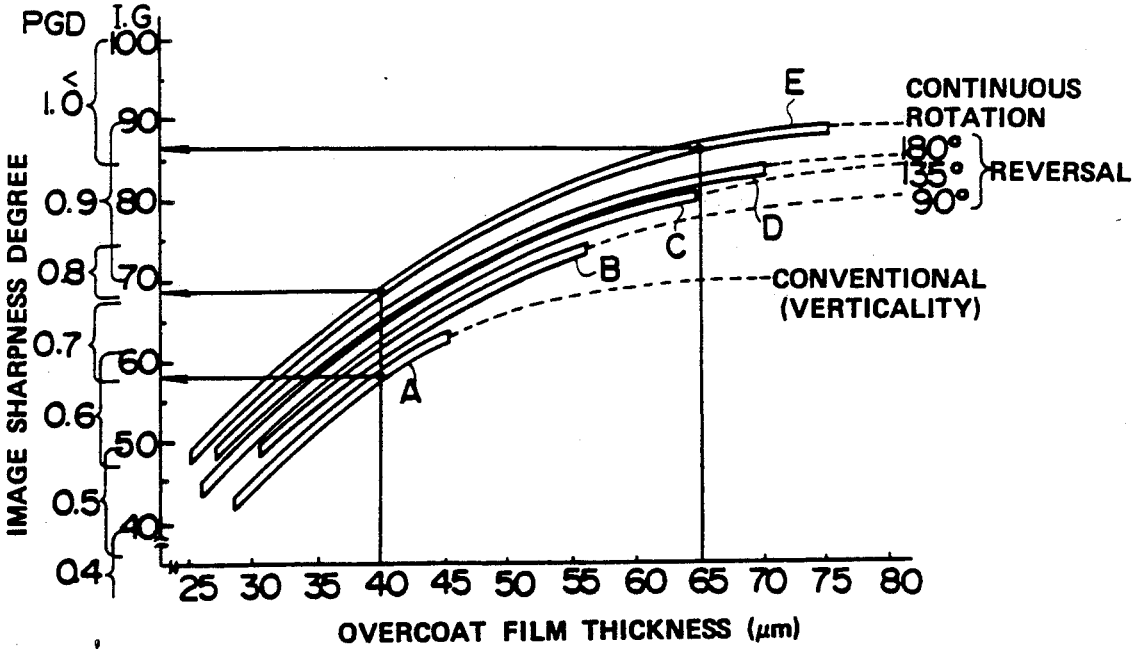
FIG. 4 is a graph showing the relationship of film thicknesses of the paint vs. degrees of image gross.

FIG. 4 shows the influence of the rotation of the vehicle body W about its horizontal axis upon degrees of flatness on the coat surface of the substrate expressed in a degree of image gloss.

In FIG. 4, reference symbol A denotes a state of the coat surface obtained without the rotation of the vehicle body W in conventional manner. Reference symbol B denotes a state of the coat surface obtained by the rotation of the body W which is carried out in a clockwise direction at the angle of 90 degree, namely, from the position of FIG. 2(*a*) through FIG. 2(*b*) to FIG. 2(*c*) and then reversed in the opposite direction back to the original position of FIG. 2(*a*) from which, namely, from FIG. 2(*i*), the body W in turn is continued to be rotated in the same direction through FIG. 2(*h*) to FIG. 2(*g*) and then turned again in the counterclockwise direction therefrom through FIG. 2(*h*) to the original position of FIG. 2(*i*). Reference symbol C demonstrates a state of the coat obtained when the rotation of the body W is carried out first in a clockwise direction at the angle of 135 degrees, namely, from the original position of FIG. 2(*a*) through FIGS. 2(*b*) and (*c*) to FIG. 2(*d*) and reversed in a counterclockwise direction therefrom through FIGS. 2(*c*), (*b*) to FIG. 2(*a*) from which, namely, from FIG. 2(*i*), the rotation is continued to FIG. 2(*h*) and then reversed again in a clockwise direction to the original position of FIG. 2. Reference symbol D demonstrates a state of the surface of the coat which was obtained by the rotation of the body W at the angle of 180 degrees in a clockwise direction from the position of FIGS. 2(*a*) to (*e*) and then by reversal of the rotation in a counterclockwise direction back to the original position of FIG. 2(*a*). In FIG. 4, reference symbol E shows a state of the coat surface obtained when the body W is continuously rotated around in one way from the original position of FIG. 2(*a*) through FIGS. 2(*b*), (*c*), (*d*), (*e*), (*f*), (*g*), and (*h*) to the original position of FIG. 2(*i*), namely, FIG. 2(*a*).

As shown in FIG. 4, it is found that higher degrees of flatness on the coat surfaces are given when the body W is rotated as in the cases of reference symbols B, C, D and E, than reference symbol A, if the film thicknesses are the same. It is also found that a higher degree of flatness can be produced when the body W is rotated continuously in one direction at the angle of 360 degrees than when the rotation is carried out in one direction and then reversed in the opposite direction or directions. It is further found in the result shown in FIG. 4 that the coat obtainable without rotation of the body W is thin in a film thickness, thus leading to a lower degree of flatness and producing a limit upon thickening its film thickness.

When the film thickness of 65 μm was formed on the body W by rotating continuously in one direction at the angle of 360 degrees, a degree of flatness is "87" when expressed in an image gloss (I.G.) as a degree of image, namely, the lowest limit value when the PGD value is 1.0. In the case of the coat in the film thickness of 40 μm formed without rotation, a degree of flatness is "58" when expressed in the image gloss (I.G.), or the lowest limit value when the PGD value is 0.7, while the coat in the film thickness of 40 μm formed by the continuous rotation in one direction at the angle of 360 degrees provides a degree of flatness which is "68" when expressed in the image gloss (I.G.) as a degree of image sharpness, or the lowest limit value when the PGD degree is 0.8. It is understood that the definition for the image gloss (I.G.) in the image sharpness degree is a percentage of an image sharpness on an objective coat surface on the basis of the image gloss of "100" when a mirror surface of a black glass is used, and a PGD value is a value rating identification degrees of reflected images from 1.0. The PGD value gets lower as the degree of flatness gets lower.

The data shown in FIGS. 3 and 4 were obtained by overcoating in the spraying step P2 above under following test conditions:

a) Paint: melamine alkyd (black)
   Viscosity: 22 seconds/20° C. (measured by Ford Cup #4)
b) Film coater: Minibell (16,000 r.p.m.)
   Shaping air: 2.0 kg./cm$^2$ c)
c) Spraying amounts: sprayed two times
   First time: 100 cc/minute
   Second time: 150–200 cc/minute
d) Setting time/temperature: 10 minutes/room temperature
e) Baking temperature/time: 140° C. /25 minutes
f) Degree of flatness on overcoat surface: 0.6 (PGD) (intercoating on PE tape)
g) Time period for rotation and reversal:
   10 minutes (for the setting step)
   10 minutes (for the baking step)
h) Coating Substrate: The side surfaces of a square pipe with a 30 cm side are coated and supported rotatably at its center.
i) Rotational speeds: 6, 30, and 60 r.p.m.

It is found that there is no variation in degrees of flatness on the coat surfaces obtained by the different speeds of rotation.

It is noted that the paint used as shown in FIG. 3 is likely to start sagging within one minute at the time of the start of the setting step, i.e., at the time of completion of the coating, when the paint is coated in the film thickness of 65 μm. Accordingly, if the paint is used in the film thickness as thick as 65 μm, no problem is caused when the rotation of the body starts soon after the completion of the spraying, however, the risk is incurred that the paint sags while the body is transferred to the setting step P3 from the spraying step P2 if the time required for transferal takes longer than 1 minute.

Relationship of Swelled Mass with Viscosity of Paint

A paint having a high flowability is suitable for improvement in a degree of smoothness or flatness on the coat surface, however, it may present the disadvantage that it is likely to form a mass on an edge of the end portion of a substrate such as the vehicle body W.

Figure 16:
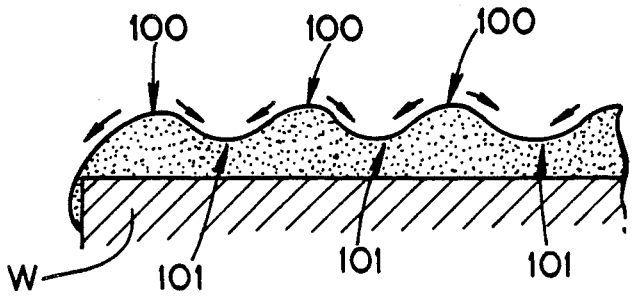
FIGS. 16, 17 and 18 are schematic sectional views showing changes of states of a coat on an edge portion of the substrate.
Figure 17:
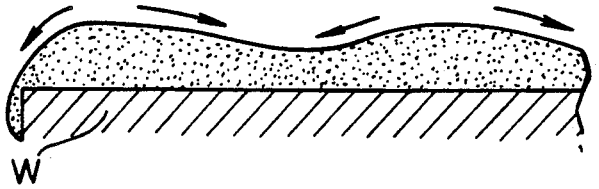
Figure 18:
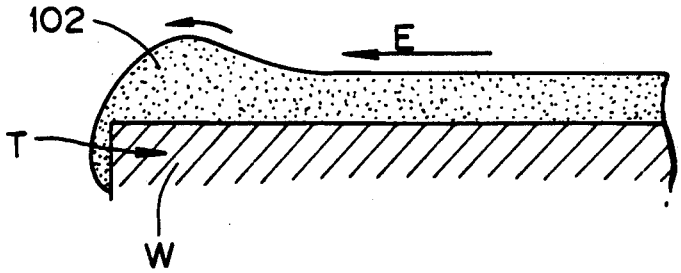

As shown schematically in FIGS. 16 to 18, irregularity on the coat surface immediately after the coating, as shown in FIG. 16, is flattened due to a flowability of the paint such that a projected portion 100 of the paint migrates so as to imbed a concave portion 101 to thereby have the surface of the coat flattened as shown in FIG. 17. In other words, the paint having a large viscosity is likely to readily migrate due to a surface tension acting upon the coat surface and disperse in all directions within a narrow area, thereby flattening the coat surface. However, once the coat surface gets flattened, the surface tension then acts in one direction as indicated by the arrow E accumulating the paint on an edge portion T of the body W, and the paint accumulated swells as shown in FIG. 18. The portion at which the paint swells on the edge portion of the body is called "mass" or "swelled mass" in this specification. In other words, the swelled mass is formed followed by the flattening of the coat surface.

In order to allow the paint to form no swelled mass, it is necessary that the paint has the properties that its flowability is so high immediately after the spraying that its surface tension can be utilized and additionally that its flowability is lowered to an extent to which a surface tension does not act or little acts any more once the coat surface gets flattened.

In order to provide the paint with such former properties as have been described hereinabove, a viscosity at which the paint is sprayed may be lowered or an amount of an agent for preventing sagsof the paint may be reduced. In order to lower the flowability of the paint subsequent to the flattening of the coat surface, there may be increased an amount of a solvent which can volatilize at earlier stages.

With the above taken into consideration, samples have been prepared as shown in Tables 4-1 and 4-2 below using paints as shown in Tables 1 and 2 below. In all tables below, the viscosity of spraying has been measured using Ford Cup #4 at 20° C.

Solvents to be used for preparing samples have the following boiling points:

Ethyl acetate 77.1° C.
Toluene 110° C.
Xylene 135°-145° C.
Solvesso 100 (Esso) 157°-174° C.
Solvesso 150 (Esso) 188°-210° C.

For the samples prepared in the manner as have been described hereinabove, they are measured for amounts of swelled mass, sags from punched holes, and PGD degrees under the following conditions.

Test Pieces

1. Shape

A flat plate (300 mm×100 mm×0.7 mm) was punched at its center portion to give a 15 mm-diameter hole.

2. Substrate Treatment

Cationic electrodeposition: 20 μm; baked at 175° C. for 30 minutes

Intercoting: 35 μm; baked at 140° C. for 25 minutes (polyester paint of a thermosetting and oil-free type; gray)

Wet rubbing for intercoating: water-resistant paper #800

Overcoating: paints as shown in Tables 1 and 2 below

A: thermosetting melamine alkyd paint; black
B: theremosetting melamine acryl paint; black 3. Coating Conditions:

Coater:

Minibell (bell size: 60 mm)
22,000 r.p.m.; voltage: −90 kv
shaping air force: 3.0 kg/cm$^2$
distance from spray gun: 30 cm Position of spraying: sprayed on a surface of the test piece in the lengthwise and vertical direction Velocity of spraying: the test piece moved at the rate of 3 meters per minute while the coater is fixed.

Number of stages: two stages (in the interval of two minutes)

Ratio of film thicknesses: 1 to 2 (film thickness in the first stage to that in the second stage)

Ambient temperature in a booth: 20° C.; air velocity: 0.2 meter per second

Baking: 10 minutes after setting; 140° C. for 25 minutes (rate of elevation from 20° C. to 140° C.: 15° C. per minute)

Film thickness: 60 and 70 μm (dry)

4. Conditions for rotating the test pieces:

In order to adapt the test coating conditions to meet with actual coating conditions for the vehicle body, the test pieces were sprayed with the paint and allowed to stand for two minutes and mounted to a rotater in the distance away by 80 cm from the center of its rotary axis. Then the test pieces were rotated at the rate of 10 rpm for eight minutes in the setting step and then for 5 minutes after the start of the baking step. The baking was continued thereafter while the rotation was suspended.

TABLE 1

| VELOCITY OF SPRAYING (sec) | COMPONENTS OF PAINT A (% by weight) | | | | |
|---|---|---|---|---|---|
| | MELAMINE ALKYD | CARBON BLACK | AGENT OF SAG PREVENTING | SURFACE ADJUSTING AGENT | SOLVENT |
| 20 | 43.76 | 1.35 | 2.88 | 0.01 | 52 |
| 18 | 40.11 | 1.24 | 2.64 | " | 56 |
| 16 | 34.06 | 1.05 | 2.28 | " | 62 |
| 15 | 30.7 | 0.95 | 2.04 | " | 66 |
| 14 | 27.34 | 0.85 | 1.80 | " | 70 |

TABLE 2

| VELOCITY OF SPRAYING (sec) | COMPONENTS OF PAINT B (% by weight) | | | | |
|---|---|---|---|---|---|
| | MELAMINE ALKYD | CARBON BLACK | AGENT OF SAG PREVENTING | SURFACE ADJUSTING AGENT | SOLVENT |
| 20 | 41.48 | 1.28 | 2.73 | 0.01 | 54.5 |
| 18 | 38.24 | 1.18 | 2.57 | " | 58 |
| 16 | 32.82 | 1.01 | 2.16 | " | 64 |
| 15 | 29.62 | 0.92 | 1.95 | " | 67.5 |
| 14 | 26.43 | 0.82 | 1.74 | " | 71 |

TABLE 3

| Sample No. | Viscosity (sec.) | Sag Preventive Agent (Wt. %) | Composition of Solvents (% by weight) | | | | | Test Results | | | | Evaluation |
|---|---|---|---|---|---|---|---|---|---|---|---|---|
| | | | Toluene | Solvesso 100 | Solvesso 150 | Others | Low-B.P. Solvents | Thickness, 60 μm | | Thickness, 70 μm | | |
| | | | | | | | | Mass (in mm) | PGD | Mass (in mm) | PGD | |
| A-1 | 20 | 6 | 25 | 30 | 45 | | 25 | 4.0 | 1.0 | 4.8 | 1.0 | NG |
| A-2 | 20 | 6 | 35 | 30 | 35 | | 35 | 3.8 | 0.9 | 4.3 | 1.0 | NG |
| A-3 | 20 | 6 | 50 | 25 | 25 | | 50 | 3.2 | 0.8 | 3.3 | 0.9 | NG |
| A-4 | 20 | 6 | 55 | 25 | 20 | | 55 | 2.8 | 0.8 | 3.0 | 0.9 | NG |
| A-5 | 18 | 6 | 25 | 30 | 45 | | 25 | 4.4 | 1.0 | 5.6 | 1.2 | NG |
| A-6 | 18 | 6 | 35 | 30 | 35 | | 35 | 4.0 | 1.0 | 5.0 | 1.0 | NG |
| (Ex.) A-7 | 18 | 6 | 50 | 25 | 25 | | 50 | 3.3 | 1.0 | 3.5 | 1.0 | OK |
| (Ex.) A-8 | 18 | 6 | 55 | 25 | 20 | | 55 | 3.1 | 1.0 | 3.3 | 1.0 | OK |
| A-9 | 16 | 6 | 25 | 30 | 45 | | 25 | 8.2 | 1.2 | 12.0 | 1.2 | NG |
| A-10 | 16 | 6 | 35 | 30 | 35 | | 35 | 5.8 | 1.2 | 7.2 | 1.2 | NG |
| A-11 | 16 | 6 | 50 | 25 | 25 | | 50 | 3.5 | 1.0 | 3.8 | 1.0 | NG |
| (Ex.) A-12 | 16 | 6 | 55 | 25 | 20 | | 55 | 3.3 | 1.0 | 3.5 | 1.0 | OK |

TABLE 3-continued

| Sample No. | Viscosity (sec.) | Sag Preventive Agent (Wt. %) | Composition of Solvents (% by weight) Toluene | Solvesso 100 | Solvesso 150 | Others | Low-B.P. Solvents | Test Results Thickness, 60 μm Mass (in mm) | PGD | Thickness, 70 μm Mass (in mm) | PGD | Evaluation |
|---|---|---|---|---|---|---|---|---|---|---|---|---|
| (Ex.) A-13 | 16 | 6 | 45 | 25 | 25 | EtAc 5 | 50 | 3.3 | 1.0 | 3.5 | 1.2 | OK |
| A-14 | 16 | 6 | 55 | 10 | 10 | EtAc 20 | 75 | 2.8 | 0.9 | 3.3 | 1.0 | NG |
| (Ex.) A-15 | 16 | 6 | 65 | 20 | 15 | | 65 | 3.2 | 1.0 | 3.4 | 1.0 | OK |
| (Ex.) A-16 | 16 | 6 | 75 | 15 | 10 | | 75 | 3.2 | 1.0 | 3.3 | 1.0 | OK |
| A-17 | 16 | 6 | 80 | 10 | 10 | | 80 | 3.0 | 1.0 | 3.2 | 1.0 | NG *) |
| A-18 | 15 | 6 | 50 | 25 | 25 | | 50 | 4.0 | 1.0 | 4.5 | 1.0 | NG |
| A-19 | 15 | 6 | 55 | 25 | 10 | | 55 | 3.7 | 1.0 | 3.9 | 1.0 | NG |
| (Ex.) A-20 | 15 | 6 | 65 | 20 | 15 | | 65 | 3.3 | 1.0 | 3.5 | 1.0 | OK |
| A-21 | 15 | 6 | 45 | 25 | 25 | EtAc 5 | 50 | 3.7 | 1.0 | 4.0 | 1.0 | NG |
| (Ex.) A-22 | 15 | 6 | 45 | 25 | 20 | EtAc 10 | 55 | 3.3 | 1.0 | 3.5 | 1.0 | OK |
| A-23 | 14 | 6 | 50 | 25 | 25 | | 50 | 4.6 | 1.2 | 5.4 | 1.2 | NG |
| A-24 | 14 | 6 | 50 | 15 | 10 | EtAc 25 | 75 | 3.7 | 1.0 | 4.0 | 1.0 | NG |
| A-25 | 14 | 6 | 45 | 15 | 10 | EtAc 30 | 75 | 3.2 | 0.9 | 3.5 | 1.0 | NG *) |

Note: *) Pinholes occurred.

TABLE 4

| Sample No. | Viscosity (sec.) | Sag Preventive Agent (Wt %) | Composition of Solvents (% by weight) Toluene | Solvesso 100 | Solvesso 150 | Others | Low-B.P. Solvents | Test Results Thickness, 60 μm Mass (in mm) | PGD | Thickness, 70 μm Mass (in mm) | PGD | Evaluation |
|---|---|---|---|---|---|---|---|---|---|---|---|---|
| B-1 | 20 | 6 | 45 | 55 | | | 45 | 3.8 | 1.0 | 4.2 | 1.0 | NG |
| B-2 | 20 | 6 | 50 | 50 | | | 50 | 3.3 | 0.9 | 3.5 | 1.0 | NG |
| B-3 | 20 | 6 | 55 | 45 | | | 55 | 2.8 | 0.9 | 3.1 | 1.0 | NG |
| B-4 | 18 | 6 | 45 | 55 | | | 45 | 4.0 | 1.0 | 4.6 | 1.2 | NG |
| (Ex.) B-5 | 18 | 6 | 50 | 50 | | | 50 | 3.3 | 1.0 | 3.5 | 1.2 | OK |
| (Ex.) B-6 | 18 | 6 | 55 | 45 | | | 55 | 3.0 | 1.0 | 3.2 | 1.0 | OK |
| B-7 | 16 | 6 | 45 | 55 | | | 45 | 4.4 | 1.0 | 5.1 | 1.0 | NG |
| B-8 | 16 | 6 | 50 | 50 | | | 50 | 3.7 | 1.0 | 4.0 | 1.0 | NG |
| (Ex.) B-9 | 16 | 6 | 55 | 45 | | | 55 | 3.3 | 1.0 | 3.5 | 1.0 | OK |
| (Ex.) B-10 | 16 | 6 | 40 | 50 | | EtAc 10 | 50 | 3.2 | 1.0 | 3.4 | 1.0 | OK |
| (Ex.) B-11 | 16 | 6 | 40 | 50 | | EtAc 10 | 50 | 3.2 | 1.0 | 3.4 | 1.0 | OK |
| (Ex.) B-12 | 16 | 6 | 40 | 40 | | EtAc 20 | 60 | 2.8 | 1.0 | 3.2 | 1.0 | OK |
| (Ex.) B-13 | 16 | 6 | 60 | 40 | | | 60 | 3.3 | 1.0 | 3.5 | 1.0 | OK |
| (Ex.) B-14 | 16 | 6 | 70 | 30 | | | 70 | 3.1 | 1.0 | 3.3 | 1.0 | OK |
| B-15 | 16 | 6 | 80 | 20 | | | 80 | 3.0 | 1.0 | 3.2 | 1.0 | NG *) |
| B-16 | 16 | 6 | 40 | 30 | | EtAc 30 | 70 | 2.5 | 1.0 | 2.8 | 1.0 | NG *) |
| B-17 | 15 | 6 | 45 | 55 | | | 45 | 4.3 | 1.0 | 4.5 | 1.0 | NG |
| B-18 | 15 | 6 | 50 | 50 | | | 50 | 4.0 | 1.0 | 4.3 | 1.0 | NG |
| B-19 | 15 | 6 | 40 | 50 | | EtAc 10 | 50 | 3.4 | 1.0 | 3.8 | 1.0 | NG |
| (Ex.) B-20 | 15 | 6 | 45 | 35 | | EtAc 20 | 65 | 3.2 | 1.0 | 3.4 | 1.0 | OK |
| B-21 | 15 | 6 | 45 | 25 | | EtAc 30 | 75 | 3.0 | 1.0 | 3.2 | 1.0 | NG *) |
| B-22 | 15 | 6 | 55 | 45 | | | 55 | 3.7 | 1.0 | 4.0 | 1.0 | NG |
| (Ex.) B-23 | 15 | 6 | 65 | 35 | | | 65 | 3.3 | 1.0 | 3.5 | 1.0 | OK |
| B-24 | 14 | 6 | 55 | 45 | | | 55 | 4.3 | 1.0 | 4.8 | 1.0 | NG |
| B-25 | 14 | 6 | 75 | 25 | | | 75 | 4.0 | 1.0 | 4.3 | 1.0 | NG |
| B-26 | 14 | 6 | 55 | 25 | | EtAc 20 | 75 | 3.8 | 1.0 | 4.1 | 1.0 | NG |
| B-27 | 14 | 6 | 50 | 25 | | EtAc 25 | 75 | 3.6 | 1.0 | 3.9 | 1.0 | NG |
| B-28 | 14 | 6 | 45 | 25 | | EtAc | 75 | 1.0 | 1.0 | 3.5 | 1.0 | NG |

TABLE 4-continued

| Sample No. | Viscosity (sec.) | Sag Preventive Agent (Wt %) | Composition of Solvents (% by weight) Toluene | Solvesso 100 | Solvesso 150 | Others | Low-B.P. Solvents | Test Results Thickness, 60 μm Mass (in mm) | PGD | Thickness, 70 μm Mass (in mm) | PGD | Evaluation |
|---|---|---|---|---|---|---|---|---|---|---|---|---|
| | | | | | | 30 | | | | | | *) |

Note: *) Pinholes occurred.

In Tables 3-1 and 4-1 above, the column titled "evaluation" indicates "OK" when a mass of the paint swelled on an edge portion of the substrate is 3.5 mm or smaller in width and when an image gloss on a coat surface of the substrate is 1.0 or higher as PGD value and "NG" (not good) when the mass has a width larger than the above standard value and the image gloss has a lower PGD value than the above value and when a pinhole or pinholes is or are caused even if the mass and the image gloss of the coated substrate meets the above standard values.

It has been found that samples A-11 and B-19 are acceptable ("OK" in the tables above) when used in the film thickness of 60 μm yet not good ("NG" in the tables above) in terms of the mass width of the paint swelled on the edge portion of the substrate when used in the film thickness of 70 μm. Samples A-14, B-2 and B-3 are acceptable ("OK") when sprayed in the film thickness of 70 μm yet not good ("NG") in terms of the image gloss when sprayed in the film thickness of 60 μm. Samples A-17, A-25, B-15, B-16, B-21 and B-28 are rated as "NG" because of pinholes.

It has been further found there is the tendency that an image gloss becomes lower as an amount of an agent for preventing sags of the paint contained gets larger than approximately 6% by weight while a mass of the paint swelled on an edge portion of the substrate becomes larger as the amount of the agent gets smaller than the 6% amount. Thus it is preferred that the agent for preventing sags of the paint be used in an amount that is not far away from 6% by weight, more specifically, from approximately 5% to 7% by weight.

For the paint A, when sprayed in a viscosity of 16 seconds when measured by means of Ford Cup #4 at 20° C., samples A-12, A-13, A-15 and A-16 have revealed that toluene may be contained in an amount ranging from 55% to 75% by weight. Furthemore, samples A-11 and A-13 indicate that data on a mass of the paint swelled on the edge portion of the substrate can be improved by substituting another low-boiling-point solvent for part of the toluene.

If a solvent having a low boiling point is used in an excessive amount, only a surface portion of a wet coat on the substrate gets cured faster than the inside, thereby rendering the coat surface irregular and making pinholes likely to occur during the baking step. For these reasons, it is preferred that the paint contains one solvent having a low boiling point or more in an amount of approximately 75% by weight or lower. It should be noted that, when the paint A is sprayed in the viscosity of 16 seconds, toluene as a low-boiling-point solvent in the amount of more than 75% by weight may cause pinholes on the coat surface so that it is practically inapplicable.

For the paint A, it is found that, when ethyl acetate is substituted for all the amount of toluene, such a paint did not provide a coat which satisfies both an amount of a paint mass on the edge portion of the substrate and an image gloss on the coat surface.

Although a combination of 25% of Solvesso 100 and 25% of Solvesso 150 with 50% of a low-boiling-point solvent as will be described hereinbelow makes a flowability of the resulting paint poor, substitution of toluene for part of the above components may improve its flowability, as shown in Sample A-13. The low-boiling-point solvent may include acetone (b.p. 51° C.), methyl acetate (b.p. 59° C.), methanol (b.p. 64.5° C.), ethanol (78.5° C.), industrial gasoline (60°-90° C., JIS K2201), methyl ethyl ketone (79° C.), isopropyl alcohol (82.5° C.), isopropyl acetate (89° C.), and butyl alcohol (99.5° C.).

For the paint B, a single use of toluene as a low-boiling-point solvent contained in a paint in the amount of 70% by weight or more, when sprayed in a viscosity of 16 seconds, is not preferred because pinholes are likely to occur, however, substitution of ethyl acetate for part of toluene makes the paint practically usable, as shown in Sample B-10.

Paints

The paints to be used for the coating method according to the present invention may be any paint which has been conventionally used for coating a coating substrate and may include, for example, thermosetting paints, two-component type paints, powder paints and so on. The paints may be conveniently chosen depending upon the kind of coating processes and the outside action to be applied as well as the speed of rotation. As needed, the paints may be used, for example, by adding a sagging preventive agent thereto or by diluting them with a solvent on site.

Particularly, paints to be used for coating the vehicle body W for an automobile may be ones having a number mean molecular weight ranging from about 2,000 to about 20,000 and include a solid coat of conventional type and of high solid type, a metallic base coat of conventional type and of high solid type, and a metallic clear coat of conventional type and of high solid type. The solid coat of an alkyd melamine resin of conventional type may have a number mean molecular weight ranging from about 4,000 to about 5,000 and of high solid type from about 2,000 to 3,000; the metallic base coat of an acrylic melamine resin of conventional type may have a number mean molecular weight from about 15,000 to about 20,000 and of high solid type from about 2,000 to about 3,000; the metallic clear coat of an acrylic melamine resin of conventional type may have a number mean molecular weight from about 5,000 to about 6,000 and of high solid type from about 2,000 to about 3,000; and the solid coat of a urethane isocyanate resin of conventional type may have a number mean molecular weight from about 7,000 to about 10,000 and of high solid type from about 2,000 to about 3,000. The paints having a number mean molecular weight below about 2,000, on the one hand, are in many cases of the type in which they are cured by electron beams or by ultraviolet rays and they are hard and frail, when cured, leading to the shortening of durability, because their density of cross-linkage is too high. Thus such paints are inappropriate for coating exterior panels of the vehicle body. The paints having a number mean molecular weight above 20,000, on the other, are of the type in which they have a very high viscosity so that they require a large amount of a solvent to dilute. Thus high costs are required to treat the solvent discharged. A latex polymer with a number mean molecular weight over 200,000 is not appropriate because its viscossity is elevated immediately after spraying, thus adversely affecting a degree of flatness on a coating surface.

TABLE 5

| Paint | Resin | Type | Number-Average Molecular Weight |
|---|---|---|---|
| Solid Paint | Melamine Alkyd | General High Solid | 4,000–5,000 2,000–3,000 |
| Metallic Base Paint | Melamine Acrylate | General High Solid | 15,000–20,000 2,000–3,000 |
| Metallic Clear Paint | Melamine Acrylate | General High Solid | 5,000–6,000 2,000–3,000 |

Rotation Jig and Carriage

Description on a rotation jig and a carriage for use for the rotation of the coating substrate such as the vehicle body W will be made hereinafter in conjunction with FIGS. 5 to 15.

Rotation Jig

The vehicle body W is mounted horizontally on the carriage through a pair of rotation jigs so as to be rotatable about its axis extending horizontally in a longitudinal direction of the body W.

Figure 5:
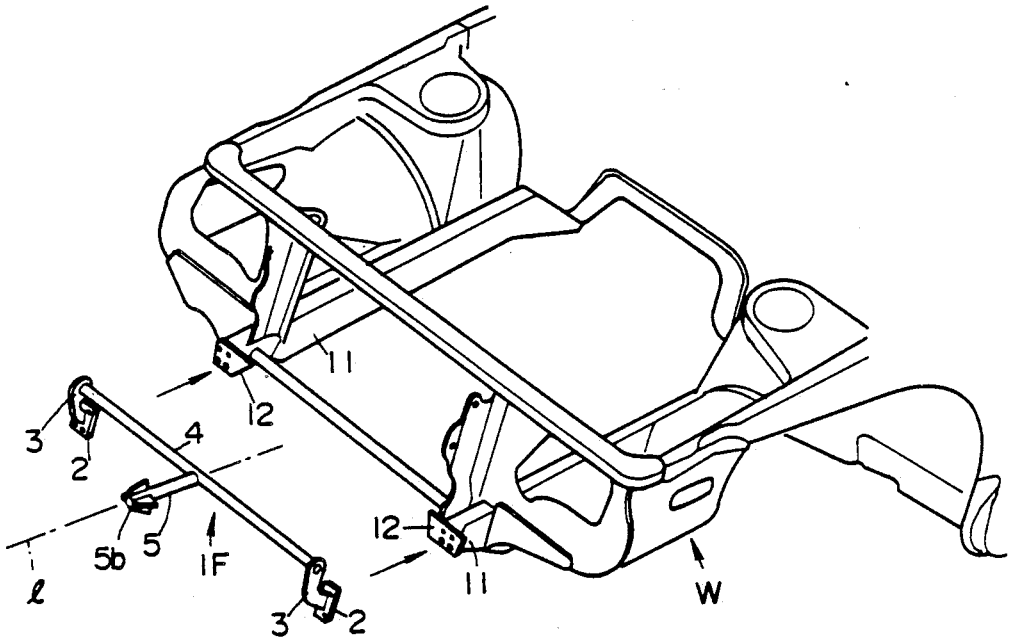
FIG. 5 is a perspective view showing a front jig for rotating the vehicle body.

FIG. 5 shows a front rotation jig 1F for horizontally supporting a forward portion of the body W. The front rotation jig 1F comprises a pair of left-hand and right-hand mounting brackets 2, a pair of left-hand and right-hand stays 3 welded to the corresponding left-hand and right-hand mounting brackets 2 and a connection bar 4 for connecting the pair of the stays 3, and a rotary shaft 5 connected integrally to the connection bar 4. The front rotation jig 1F is fixed at its portions of the brackets 2 to a forward end portion of a front reinforcing member of the vehicle body W such as a front side frame 11. To the front side frame 11 is usually welded mounting brackets 12 for mounting a bumper (not shown), and the brackets 2 are fixed with bolts (not shown) to the brackets 12 on the side of the body W.

Figure 6:
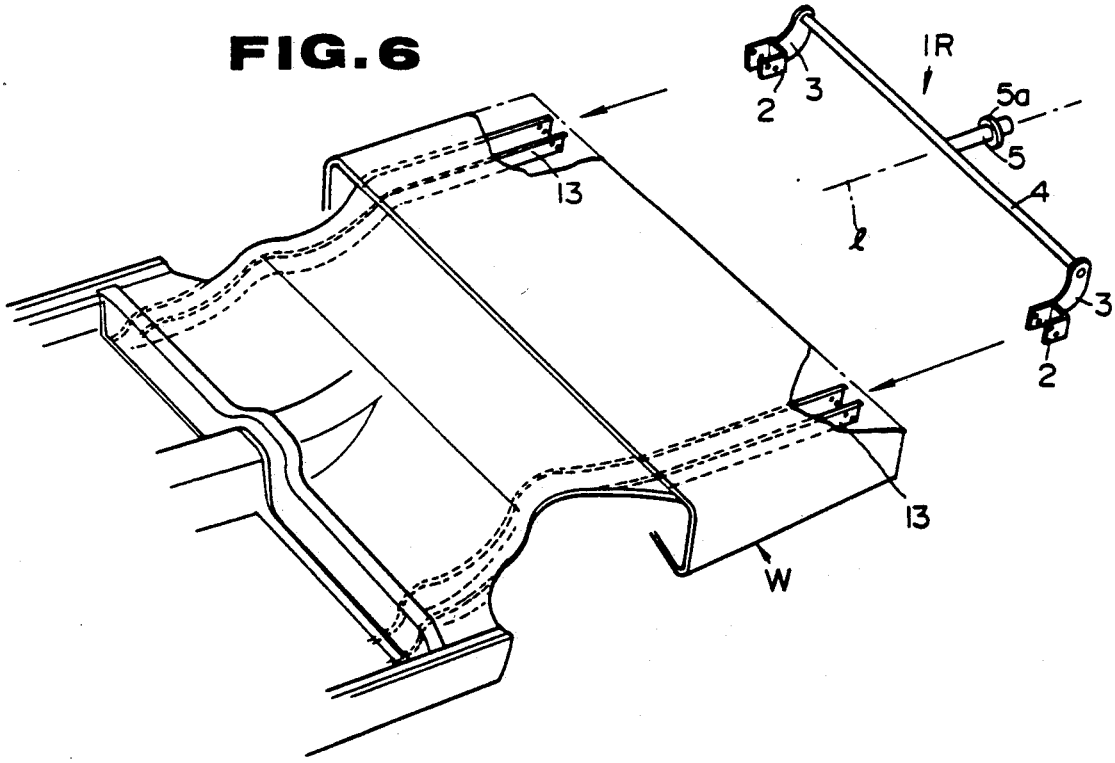
FIG. 6 is a perspective view showing a rear jig for rotating the vehicle body.

FIG. 6 shows a rear rotation jig 1R for horizontally supporting a rearward portion of the vehicle body W, which substantially the same structure as the front rotation jig 1F. In the drawing, the same elements for the rear rotation jig 1R as for the front rotation jig 1F are provided with the same reference numerals as the latter. The mounting of the rear rotation jig 1R to the vehicle body W is effected by fixing brackets 2 with bolts (not shown) to the floor frame 13 disposed at a rearward end portion of the vehicle body W as a rigidity adding member. Alternatively, the rear rotation jig 1R may be mounted to the body W through a bracket for mounting the bumper, the bracket being welded to a rearward end portion of the floor frame 13.

Figure 7:
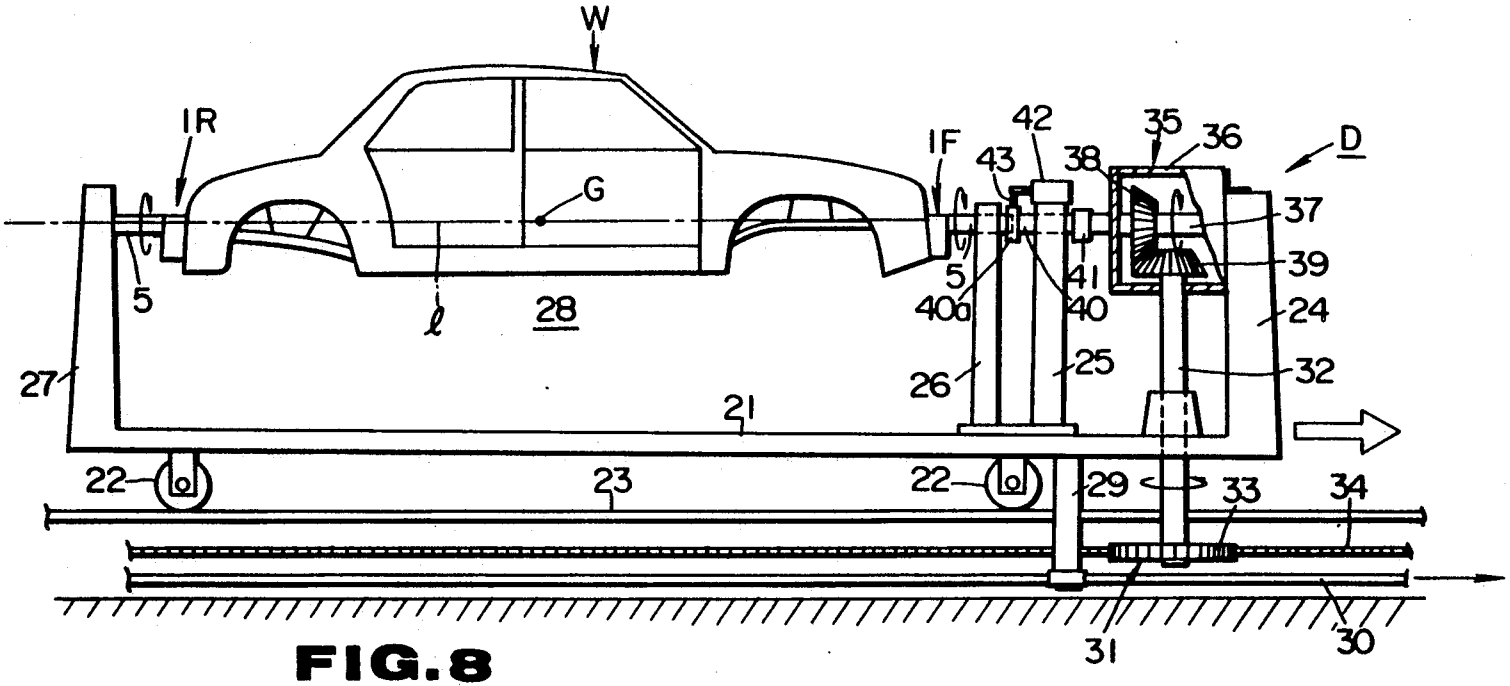
FIG. 7 is a side view showing the side portion of a vehicle-body conveying carriage for rotating the vehicle body.
Figure 9:
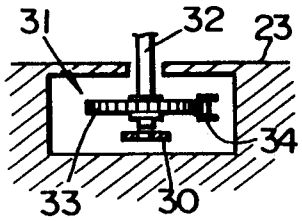
FIG. 9 is a cross-sectional view taken along line X9—X9 of FIG. 8.
Figure 8:
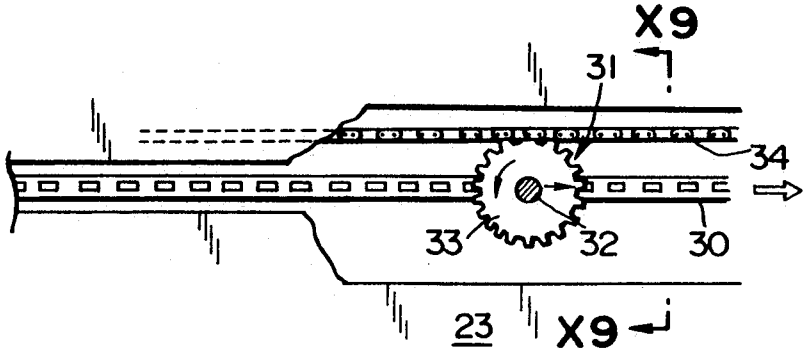
FIG. 8 is a partially cut-out plane view showing the structure of a conveying means underneath a passageway on which the carriage travels.

The front and rear rotation jigs 1F and 1R are mounted to the body W in such a manner that their respective rotary shafts 5 extend horizontally on the same straight line in its longitudinal direction when the body W is mounted on the carriage D through the front and rear rotation jigs 1F and 1R. The very straight line is the horizontal axis l about which the body W is rotated. It is preferred that the horizontal axis is designed so as to pass through the center of gravity G of the body W as shown in FIG. 7. The arrangement for the horizontal axis l to pass through the center of gravity G serves as preventing a large deviation of a speed of rotation. This can prevent an impact upon the body W accompanied with the large deviation in rotation, thus preventing the paint coated from sagging.

The front and rear rotation jigs 1F and 1R may be prepared for exclusive use with the kind of vehicle bodies.

Carriage

The carriage which will be described hereinbelow is a carriage that may be used at least during the coating step P2 and/or in the setting step P3 and that is provided with a mechanism for rotating or turning the vehicle body W about its horizontal axis l extending in a longitudinal direction thereof.

Referring to FIG. 7, the carriage D is shown to include a base 21 and wheels 22 mounted to the base 21 with the wheels 22 arranged to operatively run on rails 23. On the base 21 is mounted one front support 24, two intermediate supports 25 and 26, and one rear support 27, each standing upright from the base 21, as shown in the order from the forward side to the rearward side in a direction in which the vehicle body W is conveyed. Between the intermediate supports 25, 26 and the rear support 27 is formed a space 28 within which the body W is mounted through the front and rear rotation jigs 1F and 1R.

The vehicle body W is loaded in the space 28 and supported rotatably at its forward portion by the intermediate support 26 through the front rotation jig 1F and at its rearward portion by the rear support 27 through the rear rotation jig 1R.

Figure 10A:
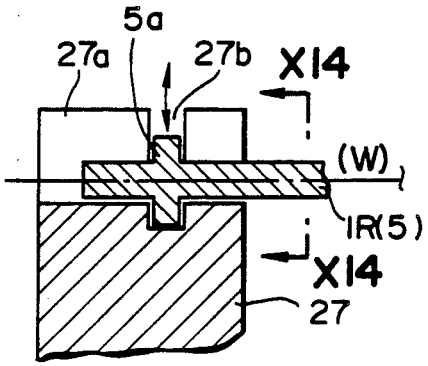
FIGS. 10(*a*), 10(*b*) and 10(*c*), are cross-sectional side view showing a connecting portion at which the carriage is connected to a rotary jig.
Figure 10B:
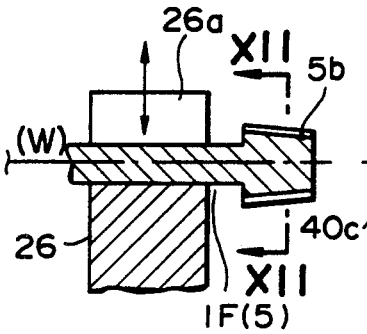
Figure 10C:
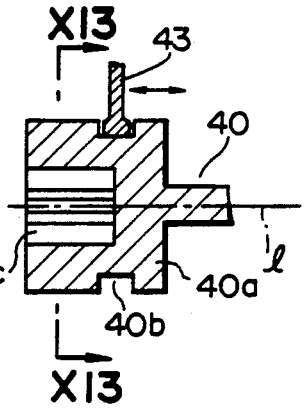
Figure 11:
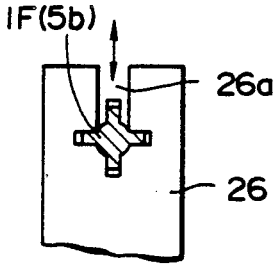
FIG. 11 is a cross-sectional view taken along line X11—X11 of FIG. 10.
Figure 12:
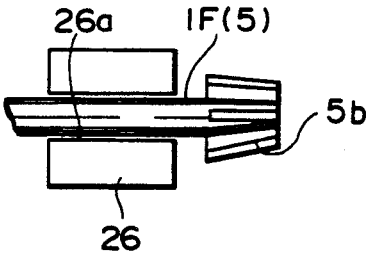
FIG. 12 is a plane view of FIG. 10.
Figure 13:
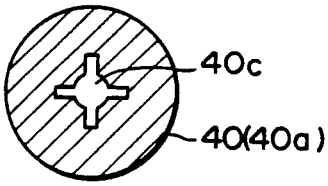
FIG. 13 is a cross-sectional view taken along line X13—X13 of FIG. 10.

As shown in FIGS. 10, 11, and 12, on the one hand, the intermediate support 26 is provided at its top surface with a groove **26*a* which in turn is designed so as to engage or disengage the rotary shaft 5 of the front rotation jig 1F with or from the support 26** in a downward direction or in an upward direction.

Figure 14:
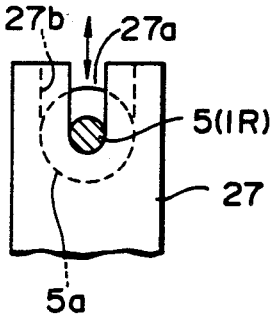
FIG. 14 is a cross-sectional view taken along line X14—X14 of FIG. 10.
Figure 15:
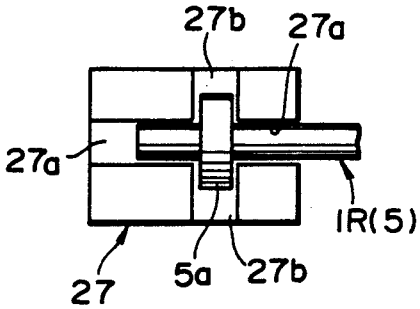
FIG. 15 is a plane view of FIG. 14.

As shown in FIGS. 10, 14, and 15, on the other hand, the rear support 27 is provided at its top surface with a groove **27*a* which engages or disengages the rotary shaft 5 of the rear rotation jig 1R with or from the rear support 27. The rear rotation jig 1R is further provided with a groove 27*b* in a shape corresponding to a flange portion 5*a* provided on the rotary shaft 5 of the rear rotation jig 1R, the groove being communicated with the groove 27*a***.

This arrangement permits the engagement or disengagement of the rotary shafts 5 with or from the front and rear rotation jigs 1F and 1R in a downward direction or in an upward direction, but it allows the rear rotation jig 1R to be unmovable in a longitudinal direction in which the horizontal axis extends due to a stopper action of the flange portion **5*a***.

As shown in FIGS. 10, 11, and 12, the rotary shaft 5 of the front rotation jig 1F is provided at its end portion with a connection portion **5*b* through which a force of rotation of the rotary shaft 5 of the front rotation jig 1F** is applied to the vehicle body W, as will be described hereinbelow.

From the base 21 extends downwardly a stay 29 to a lower end portion of which is connected a retraction wire 30. The retraction wire 30 is of endless type and is drivable in one direction by a motor (not shown). The retraction wire 30 thus drives the carriage D in a predeterminated direction in which the body W should be conveyed. The motor should be disposed in a safe place from the viewpoint of security from explosion.

The rotation of the vehicle body W may be carried out using a movement of the carriage D, that is, using a displacement of the carriage D with respect to the rails 23. The displacement of the carriage D may be converted to a force of rotation using a mechanism 31 for converting the displacement of the carriage D into rotation. The mechanism 31 comprises a rotary shaft 32 supported rotatably by the base 21 and extending in a vertical direction from the base 21, a sprocket 33 fixed on the lower end portion of the rotary shaft 32, and a chain 34 engaged with the sprocket 33. The chain 34 is disposed in parallel to the retraction wire 30 in such a state that it does not move along the rails 23. As the carriage D is retracted by the retraction wire 30, the sprocket 33 allows the rotary shaft 32 to rotate because the chain 34 is unmovable.

A force of rotation of the rotary shaft 32 is transmitted to the rotary shaft 5 of the front rotation jig 1F through a transmitting mechanism 35 which comprises a casing 36 fixed on a rearward side surface of the front support 24, a rotary shaft 37 supported rotatably to the casing 36 and extending in a longitudinal direction of the body W, a pair of bevel gears 38 and 39 for rotating the rotary shaft 37 in association with the rotary shaft 32, and a connection shaft 40 connected to the front support 25 rotatably and slidably in the longitudinal direction thereof. The connection shaft 40 is spline connected to the rotary shaft 37, as indicated by reference numeral 41 in FIG. 7. This construction permits a rotation of the connection shaft 32 to rotate the rotary shaft 40. It is understood that the rotary shaft 37 and the connection shaft 40 are arranged so as to be located on the horizontal axis l extending in a longitudinal direction of the body W. The connection shaft 40 is connected to or disconnected from the front rotary shaft 5 of the front rotation jig 1F. More specifically, as shown in FIGS. 10 to 12, the front rotary shaft 5 of the front rotation jig 1F is provided at its end portion with a connecting portion **5*b* in a cross shape, while the connection shaft 40 is provided at its end portion with a box member 40*a* having an engaging hollow portion 40*c* that is engageable tightly with the connection portion 5*b* of the front rotary shaft 5 as shwon in FIGS. 10 and 12. By slidably moving the connection shaft 40 by a rod 43, for example, using a hydraulic cylinder 42, the connection portion 5*b* is connected to or disconnected from the box member 40*a* at its engaging hollow portion 40*c*. The connection shaft 40 is rotatable integrally with the rotary shaft 5. The rod 43 is disposed in a ring groove 40*b* formed on an outerperiphery of the box member 40*a*, as shown in FIG. 10, inorder to cause no interference with the rotation of the connection shaft 40. With the above arrangement, thefront and rear rotary shafts 5 of the respective frontand rear rotation jigs 1F and 1R are supported by the intermediate support 26 and the rear support 27 so as to be rotatable about the horizontal and longitudinal axis yet unmovable in a longitudinal direction of the body W, when the body W is lowered with respect to the carriage D in a state that the connection shaft 40 is displaced toward the right in FIG. 7. Thereafter, the connectionportion 5*b* of the rotary shaft 5 is engaged with the connection shaft 40 through the engaging hollow portion 40*c* thereof, whereby the body W is allowed to rotateabout the predetermined horizontal axis l by retracting the carriage D by means of the retraction wire 30**. The vehicle body W can be unloaded from the carriage D in theorder reverse to that described above.

It is to be understood that the foregoing text and drawings relate to embodiments of the present invention given by way of examples but not limitation. Various other embodiments and variants are possible within the spirit and scope of the present invention.

What is claimed is:

1. A coating method in a coating line for coating a substrate with a paint containing a volatilizable solvent to form a highly reflective surface coating on the substrate, comprising:

a spraying step in which the paint is sprayed onto the substrate to form a coat in a film thickness thicker than a thickness at which the paint sags on a surface extending at least upwardly and downwardly; and a drying step comprising sequential setting and baking steps in which the substrate is held in an ambient temperature during the setting step which is lower than the ambient temperature during the baking step and in which the substrate is rotated about its horizontal axis until the paint sprayed thereon achieves a substantially sagless state, the rotation of the substrate in the setting step being carried out at a speed which is high enough to rotate the substrate from a vertical position to a horizontal position before the paint coated thereon substantially sags due to gravity yet which is low enough so as to cause no sagging as a result of centrifugal force;

wherein the paint is sprayed on the substrate at a viscosity of 16 to 18 seconds when measured by means of Ford Cup #4 at 20° C., the paint containing 50 to 75% by weight of a low-boiling-point solvent or solvents having a boiling point of 110° C. or lower.

2. A coating method as claimed in claim 1, further comprising rotating the substrate about its horizontal axis during the baking step after the substantially sagless state is achieved.

3. A coating method as claimed in claim 1, in which the substrate is rotated in one direction.

4. A coating method as claimed in claim 1, in which the substrate is rotated first in one direction and then in the opposite direction.

5. A coating method as claimed in claim 1, in which the paint sprayed is a thermosetting-type paint in a volatilizable solvent and the temperature of the setting step is high enough to substantially volatilize the solvent without curing the paint.

6. A coating method as claimed in claim 1, in which the substrate is rotated so that the horizontal axis coincides substantially with the gravitational center of the substrate.

7. A coating method as claimed in claim 1, in which the substrate has a rotational axis which extends in the longitudinal direction of the substrate.

8. A coating method as claimed in claim 1, in which the substrate is rotated at a speed of 380 cm per second or lower as measured at a radially outward tip portion of the substrate.

9. A coating method as claimed in claim 1, in which the setting step substantially volatilizes the solvent in the paint.

10. A coating method as claimed in claim 1, in which the substrate to be coated has already had coated thereon an intermediate coat.

11. A coating method as claimed in claim 1, in which the substrate is held substantially stationary during the spraying step.

12. A coating method as claimed in claim 1, in which the temperature in the setting step is in the room temperature range.

13. A coating method as claimed in claim 1, in which a preparation step is carried out prior to the spraying step for cleaning the substrate by removing foreign materials therefrom and in which the substrate is rotated about its horizontal axis in the preparation step.

14. A coating method as claimed in claim 13, in which the substrate is conveyed from the preparation step to the drying step while being supported by a carriage with a rotation device on the carriage for rotating the substrate about its horizontal axis.

15. A coating method as claimed in claim 14, in which the substrate is conveyed from the preparation step to the drying step on a single carriage.

16. A coating method as claimed in claim 1, in which the thickness at which the paint sags is approximately 40 μm or lower.

17. A coating method as claimed in claim 1, in which the total sagging is no more than 2 mm.

18. A coating method as claimed in claim 1, in which the paint is sprayed by means of electrostatic spraying.

19. A coating method as claimed in claim 1, in which the paint contains at least two solvents or more and one of the solvents is a low-boiling-point solvent.

20. A coating method as claimed in claim 1, in which the paint contains at least three solvents or more and two of the solvents are low-boiling-point solvents.

21. A coating method as claimed in claim 1, in which the low-boiling-point solvent is at least toluene.

22. A coating method as claimed in claim 21, in which the low-boiling-point solvent is toluene alone.

23. A coating method as claimed in claim 21, in which the low-boiling-point solvent is a mixture of toluene with ethyl acetate.

24. A coating method as claimed in claim 1, in which the paint is sprayed in a film thickness of 60 μm or thicker in the spraying step.

25. A coating method as claimed in claim 1, in which the paint is sprayed in a film thickness of 70μm or thicker in the spraying step.

26. A coating method as claimed in claim 1, in which a mass of the paint swelled on an edge portion of the substrate after the drying step has a width of 3.5 mm or smaller.

27. A coating method as claimed in claim 1, in which a surface of the substrate obtained after the drying step has an image gloss of 1.0 or higher as a PGD value.

28. A coating method as claimed in claim 1, in which a mass of the paint swelled on an edge portion of the substrate after the drying step has a width of 3.5 mm or smaller and a surface of the substrate obtained after the drying step has an image gloss of 1.0 or higher as a PGD value.

29. A coating method as claimed in claim 1, in which a resinous component of the paint is melamine alkyd.

30. A coating method as claimed in claim 1, in which a resinous component of the paint is melamine acrylate.

31. A coating method as claimed in claim 1, in which the paint contains an agent for preventing sags of the paint.

32. A coating method as claimed in claim 31, in which the agent for preventing sags of the paint is contained in an amount of approximately 6% by weight.

33. A coating method as claimed in claim 1, in which a resinous component of the paint has a number-average molecular weight in the range from 2,000 to 20,000.

34. A coating method as claimed in claim 1, in which the low boiling point solvent is 55 to 75% by weight of toluene alone.

35. A coating method in a coating line for coating a substrate with a paint containing a volatilizable solvent to form a highly reflective surface coating on the substrate, comprising:

a spraying step in which the paint is sprayed to form a coat in a film thickness thicker than a thickness at which the paint sags on a surface extending at least upwardly and downwardly; and a drying step comprising sequential setting and baking steps in which the substrate is held in an ambient temperature during the setting step which is lower than the ambient temperature during the baking step and in which the substrate is rotated about its horizontal axis until the paint sprayed thereon achieves a substantially sagless state, the rotation of the substrate in the setting step being carried out at a speed which is high enough to rotate the substrate from a vertical position to a horizontal position before the paint coated thereon substantially sags due to gravity yet which is low enough so as to cause no sagging as a result of centrifugal force;

wherein the paint is sprayed on the substrate at a viscosity of 18 seconds or lower when measured by means of Ford Cup #4 at 20° C., the paint containing a low-boiling-point solvent or solvents having a boiling point of 110° C. or lower in an amount of 50% by weight or higher.

36. A coating method as claimed in claim 35, in which the low-boiling-point solvent is present in a total amount of 50% to 75% by weight.

* * * * *